US005921181A

United States Patent [19]

Ritter

[11] Patent Number: 5,921,181

[45] **Date of Patent: *Jul. 13, 1999**

[54] PNEUMATIC CARTRIDGE EXPRESSING DEVICE

[76] Inventor: Ralf Ritter, Schwabenstrasse 54, 86836 Untermeitingen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/910,355

[22] Filed: Aug. 13, 1997

[30] Foreign Application Priority Data

Aug. 14, 1996 [DE] Germany ..... 196 32 717

[51] Int. Cl.[6] ..... B41F 31/08

[52] U.S. Cl. ..... 101/366; 222/327; 222/389

[58] Field of Search ..... 222/327, 389; 101/366

[56] References Cited

U.S. PATENT DOCUMENTS

| | | | |
|---|---|---|---|
| 4,174,068 | 11/1979 | Rudolph | 222/327 |
| 4,535,693 | 8/1985 | Belvederi | 101/366 |
| 4,570,832 | 2/1986 | Kroger | 222/389 |
| 5,435,462 | 7/1995 | Fujii | 222/327 |
| 5,724,890 | 3/1998 | Deschner et al. | 101/366 |

FOREIGN PATENT DOCUMENTS

| | | |
|---|---|---|
| 0 537 550 A1 | 4/1993 | European Pat. Off. . |
| 2 102 720 | 9/1972 | Germany . |
| 2 216 598 | 10/1973 | Germany . |
| 34 09 725 A1 | 9/1984 | Germany . |
| 85 12 378 U1 | 4/1986 | Germany . |
| 40 26 170 A1 | 2/1992 | Germany . |
| 295 19 348 U1 | 3/1996 | Germany . |

*Primary Examiner*—Edgar Burr
*Assistant Examiner*—Amanda B. Sandusky
*Attorney, Agent, or Firm*—Oliff & Berridge, PLC

[57] ABSTRACT

A pneumatic cartridge expressing device is shown for expressing cartridges containing viscous materials. The device has a holder that is axially longer than the cartridge, and a cap that is sealingly fitted over one axial end of the holder with a piston guided within the cap and forced by compressed air against either the one axial end of the holder or against one axial end of the cartridge. Compressed air is provided through an opening in the piston to pressurize the cartridge, and in the case where the piston seals against the one axial end of the holder, also passes into an annular gap between the cartridge and the holder to prevent bulging of the cartridge during expressing of the cartridge. Compressed air is provided through a separate opening in the cap to the annular gap in the case where the piston seals against one axial end of the cartridge.

5 Claims, 4 Drawing Sheets

PNEUMATIC CARTRIDGE EXPRESSING DEVICE

BACKGROUND OF THE INVENTION

1. Field of Invention

The invention relates to a pneumatic cartridge expressing device for expressing cartridges containing viscous materials, said cartridges consisting of a tubular body, said body being open at the rear and sealed at the front by an end wall with a mouthpiece, and a piston, said piston being inserted into the rear of the tubular body and being axially displaceable therein.

One particular area of application of the invention is expressing printing ink cartridges for filling ink fountains on printing presses. However, it is equally possible to conceive of an application for example that entails expressing cartridges filled with sealing materials, adhesives, etc. at fixed workstations or by means of manually operated devices.

2. Description of Related Art

The pneumatic expressing of printing ink cartridges in the ink fountains of printing presses is already known in practice. This is usually performed indirectly by a pneumatic cylinder charged with compressed air, the piston of said cylinder actuating a mechanical plunger that abuts at its front the piston of the cartridge to be expressed, advancing said piston. The disadvantage of these pneumatic cylinder devices consists in their cumbersome, heavy, and expensive mechanisms.

However, attempts have also been made to perform pneumatic expression of cartridges by having the compressed air act directly on the cartridge piston. This requires an air-tight seal at the rear of the tubular body of the cartridge. For this purpose, one known proposal provides a tubular housing into which the cartridge is inserted with the mouthpiece facing downward and the rear of the tubular body of the cartridge facing upward. A cap with a compressed air connection is then placed on the open upper end of the tubular housing, said cap being locked by a bayonet-lock-type mechanism to the housing. The cap has a sealing edge that abuts the rear of the tubular body of the cartridge in order to prevent compressed air from escaping from the chamber that is located behind the cartridge piston and communicates with the compressed air connection of the cap.

However, the seal at the rear end of the cartridge poses problems. Since the tubular bodies of the cartridges are usually made of plastic and have a considerable length of about 30 cm or more in the case of ink cartridges, because of the material properties of the plastic that is used, especially its shrinking behavior, said bodies exhibit considerable lengthwise tolerances. As a result, it may happen that when the cap is tightly fitted, the sealing edge does not fit tightly against the edge of the rear tubular body of the cartridge, or in the case of a cartridge with a relatively large positive lengthwise tolerance, the cap cannot be fitted properly. Another serious problem consists in the fact that the compressed air acting on the piston attempts to bulge the tubular wall of the cartridge, which results in leaks between the piston and the tubular wall of the cartridge, especially if the piston is located approximately in the middle of the length of the cartridge.

SUMMARY OF THE INVENTION

Hence, the goal of the invention is to provide a device for direct pneumatic expression of cartridges in which the problem mentioned above involving lengthwise tolerance and bulging of plastic cartridges is no longer involved.

This goal is achieved according to the invention by the device described in the claims in the form of two alternatives.

Both alternatives of the device according to the invention have in common the fact that length deviations of the tubular body of the cartridge no longer play a role.

In both alternatives of the cartridge expressing device according to the invention, the annular gap between the tubular body of the cartridge and the lengthwise wall of the holder, likewise in the form of a tubular body, is also charged with compressed air.

This charging with compressed air, including the annular gap between the tubular body of the cartridge and the holder, offers the additional advantage that the cartridge, which as has already been stated has a considerable length, cannot bulge as a result of the pneumatic pressure that builds up inside it behind the piston to advance said piston. It has been found that during pneumatic expression of cartridges by producing a corresponding pneumatic pressure behind the piston, a certain bulging of the tubular body of the cartridge takes place inside the tubular body of the cartridge, said bulging occurring especially in the middle area of the cartridge as a result of the elastic material expansion of the cartridge wall. The piston is equipped to a certain degree with radially elastic sealing lips, but material can nevertheless leak through because of the bulging of the cartridge wall. This has two disadvantageous accompanying phenomena: firstly, the piston does not scrape the inside wall of the cartridge during the expression process, as would be desirable for complete removal of the residue in the cartridge to make it essentially free of adhering residue. Secondly, the leakage between the piston and the cartridge wall caused by bulging also enables air with oxygen or moisture contained therein to penetrate the ink or other material contained in the cartridge so that incipient bonding or curing can begin and complete use or removal of the remaining ink or plastic material is no longer possible.

This problem is eliminated by the alternative devices according to the invention that also pressurize the space between the tubular body of the cartridge and the holder, since the external counterpressure prevents bulging from occurring. The advantageous result becomes immediately apparent, with extremely clean residue-free cartridges with practically no residue adhering to the cartridge wall.

DETAILED DESCRIPTION OF PREFERRED EMBODIMENTS

Figure 1:
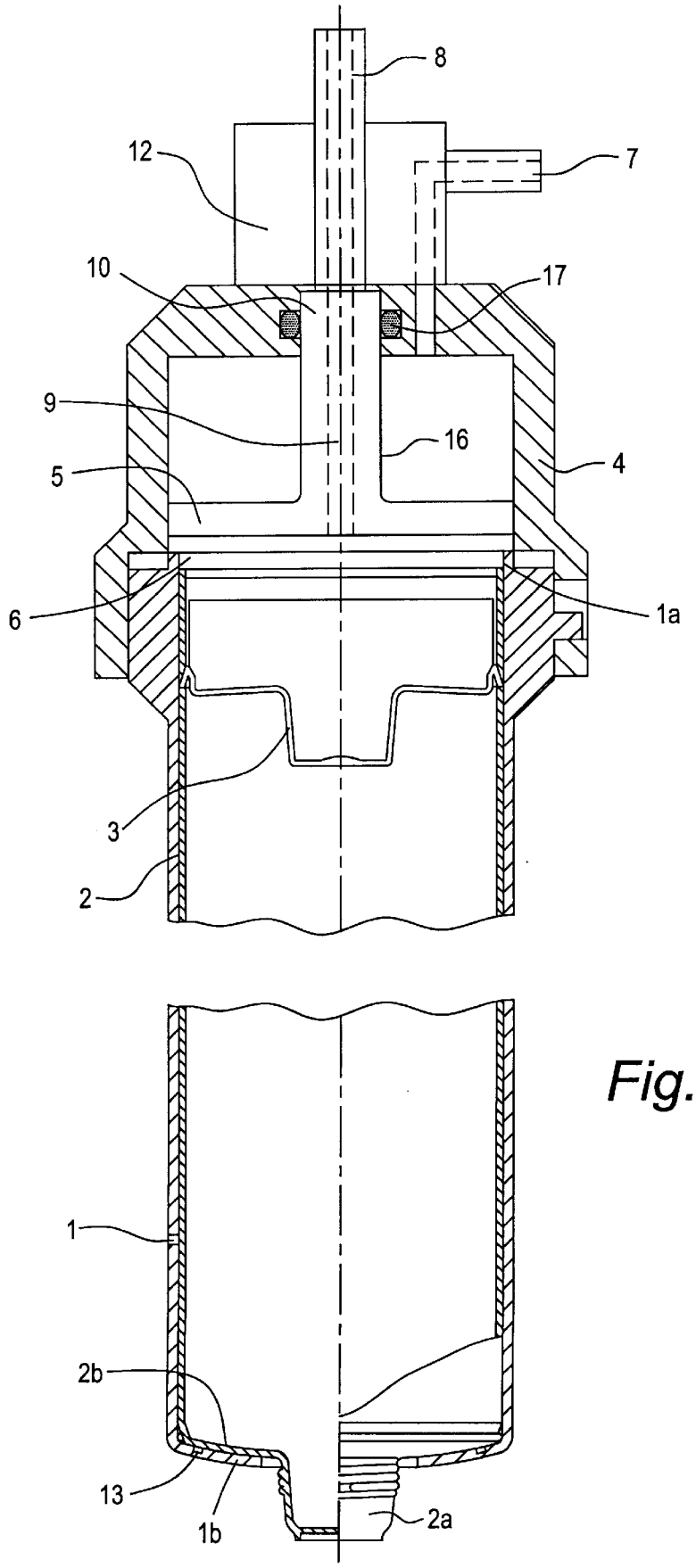
FIG. 1 is a first cartridge expressing device according to the invention in which both internal pressurization and external pressurization of the cartridge are performed with the same pressure.

In the embodiment according to FIG. 1, holder 1 has a length such that its rear la in any event projects slightly beyond the rear of cartridge 2, so that the holder is slightly longer than the cartridge. Piston 5 that can be pressurized through compressed air connection 7, therefore abuts rear 1*a* of holder 1 in a sealing fashion, together with seal 6. Cap 4 is dimensioned and designed to permit this function.

Compressed air is admitted through compressed air connection 8 and through bore 9 provided in piston 5 to pressurize the cartridge in the chamber behind cartridge piston 3. However, because holder 1 is longer than the cartridge, the compressed air also passes around the rear of cartridge 2 into the annular gap between the cartridge and the holder, so that the same pressure prevails at the outer circumference of cartridge 2 as behind cartridge piston 3. This prevents bulging of the cartridge under the influence of the pressure that is generated by cartridge piston 3 and acts on the mass located inside the cartridge, because the pressure acting externally on the cartridge forms a counterpressure that counteracts such bulging.

In this connection, of course, the front of the cartridge must fit in holder 1 with a seal to prevent compressed air from escaping from the annular gap between the cartridge and the holder into the lower opening in the holder, through which cartridge mouthpiece 2*a* projects downward out of holder 1. This seal for example is an O-ring 13 inserted into an annular groove in lower end wall 1*b* of holder 1, with cartridge 2 abutting said ring in a sealing fashion by its end wall 2*b*.

Figure 2:
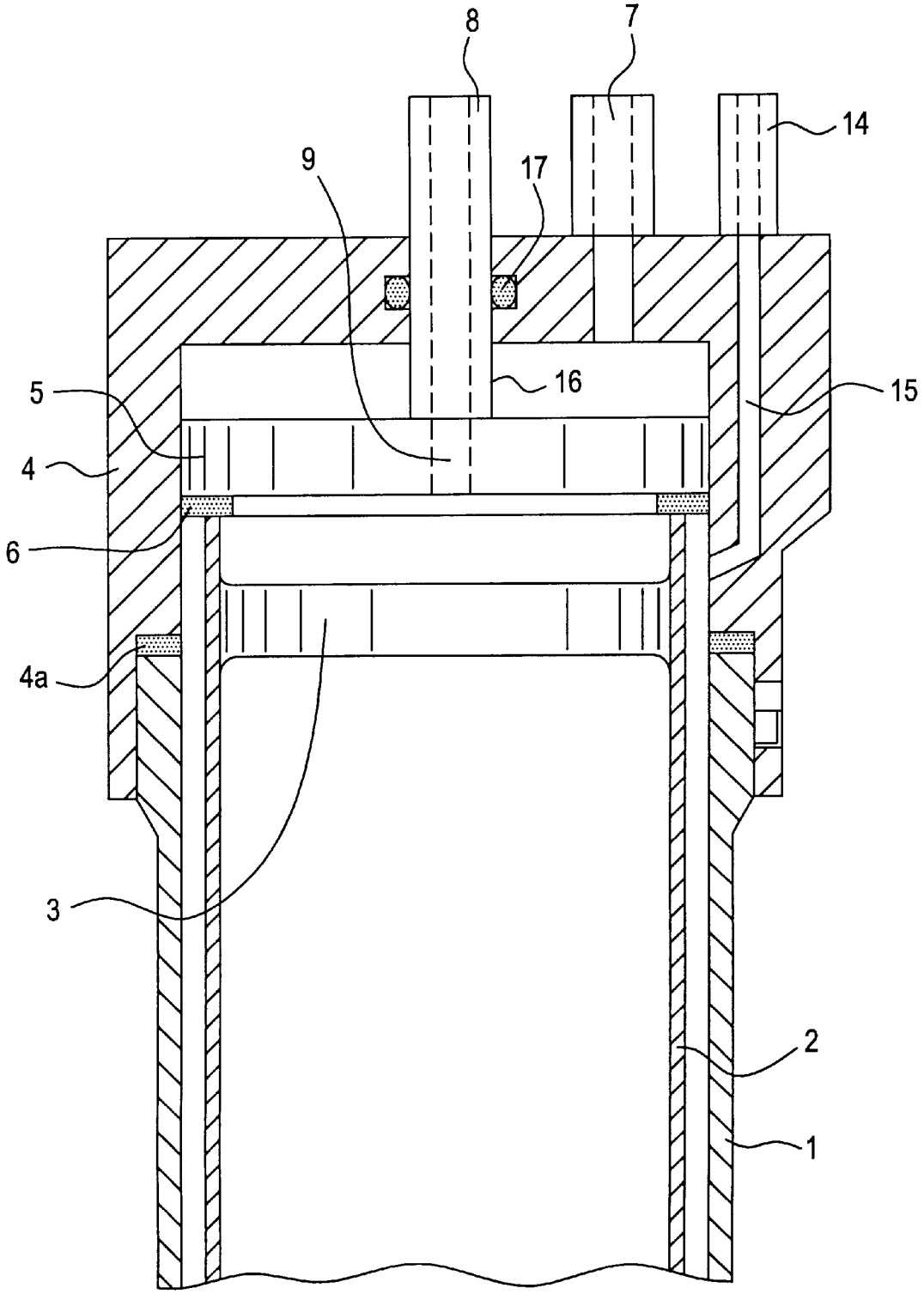
FIG. 2 shows a second pneumatic cartridge expressing device according to the invention, with internal and external pressurization of the cartridge, with the internal and external pressurization being adjustable separately.

The embodiment according to FIG. 2 differs functionally from the embodiment according to FIG. 1 in that the annular chamber between cartridge 2 and holder 1 is pressurized separately, and the pressure can be selected independently of the pressure acting on cartridge piston 3.

FIG. 2 shows the upper end area of holder 1 with cartridge 2 inserted and cap 4 in place. The arrangement is such that the rear and/or upper end of cartridge 2 clearly projects upward above the upper end of holder 1. Piston 5 is displaceable in cap 4, said piston being capable of being pressurized through a compressed air connection 7, said piston not being located in its working position at the end of holder 1 as shown in the embodiment in FIG. 1, but at the rear edge of cartridge 2, sealing off the latter. By means of a central bore 9 in cap piston 5 and a compressed air line 8 located thereon, the chamber inside cartridge 2 is pressurized behind cartridge piston 3 to produce a pressure that acts on cartridge piston 3.

In the embodiment according to FIG. 2, a seal 4*a* is provided between cap 4 and holder 1, and a third compressed air connection 14 is provided on cap 4, said connection leading through a channel 15 formed in cap 4 to an outlet on the inside circumferential wall of cap 4, said outlet being so arranged that it terminates below sealing plate piston 5, which in its working position abuts the rear cartridge end in the annular chamber between cartridge 2 and holder 1, in order to pressurize this annular chamber with a counterpressure that counteracts bulging of cartridge 2 because its internal pressure is increased through channel 9. This counterpressure therefore can be set to a lower pressure that is different from the expression pressure acting on cartridge piston 3.

Of course, an extension of cap piston 5, as in the embodiment according to FIG. 1, is guided by a seal 17 in the cylindrical wall of cap 4 surrounding it.

It is also clear that the lower end of cartridge 2, not shown in FIG. 2, is sealed off in the same way as in the embodiment according to FIG. 1 from the lower end wall of holder 1.

In the device shown in FIG. 1, a cartridge holder 1 is provided into which a cartridge 2 with a piston 3 can be inserted.

A cap 4 can be mounted on holder 1, for example by means of a bayonet-lock-type mechanism (not shown). Cap 4 forms a pneumatic cylinder with a piston 5 displaceable therein over a relatively short distance, 10 mm for example, said piston having on its underside an annular or plate-shaped rubber seal 6 or the like. When cap 4 has been placed on holder 1 and the chamber above piston 5 is pressurized through a compressed air connection 7, piston 5 travels downward until rubber seal 6 fits tightly against the rear of holder 1. The chamber in cartridge 2 behind piston 3 can then be pressurized with compressed air through compressed air connection 8 of cap 4, said air penetrating a through bore 9 in piston 5 into the rear of the cartridge and exerting a pressure on cartridge piston 3.

Piston 5 has a rear cylindrical projection 10 guided in a sealing fashion in a matching bore in cap 4. Between piston 5 and the wall of cap 4 that surrounds it, and between piston projection 10 and the bore in the cap, seals are provided in the usual fashion but are not shown for the sake of simplicity.

Compressed air connection 8 can either be mounted directly on piston 5 and moved during the piston strokes, which requires a flexible compressed air connecting line, or compressed air connection 8 can be permanently mounted on a capsule 12 permanently attached to cap 4 and can terminate in a chamber above piston extension 10, thus permitting a solid compressed air connecting line.

The pneumatic working pressure for piston 5 is greater than the pneumatic working pressure supplied through compressed air connection 8 to cartridge piston 3. The advantageous working pressure for piston 5 that serves as a sealing plate can be approximately 6 bars, and for cartridge piston 3, approximately 3 to 4 bars.

Figure 3:
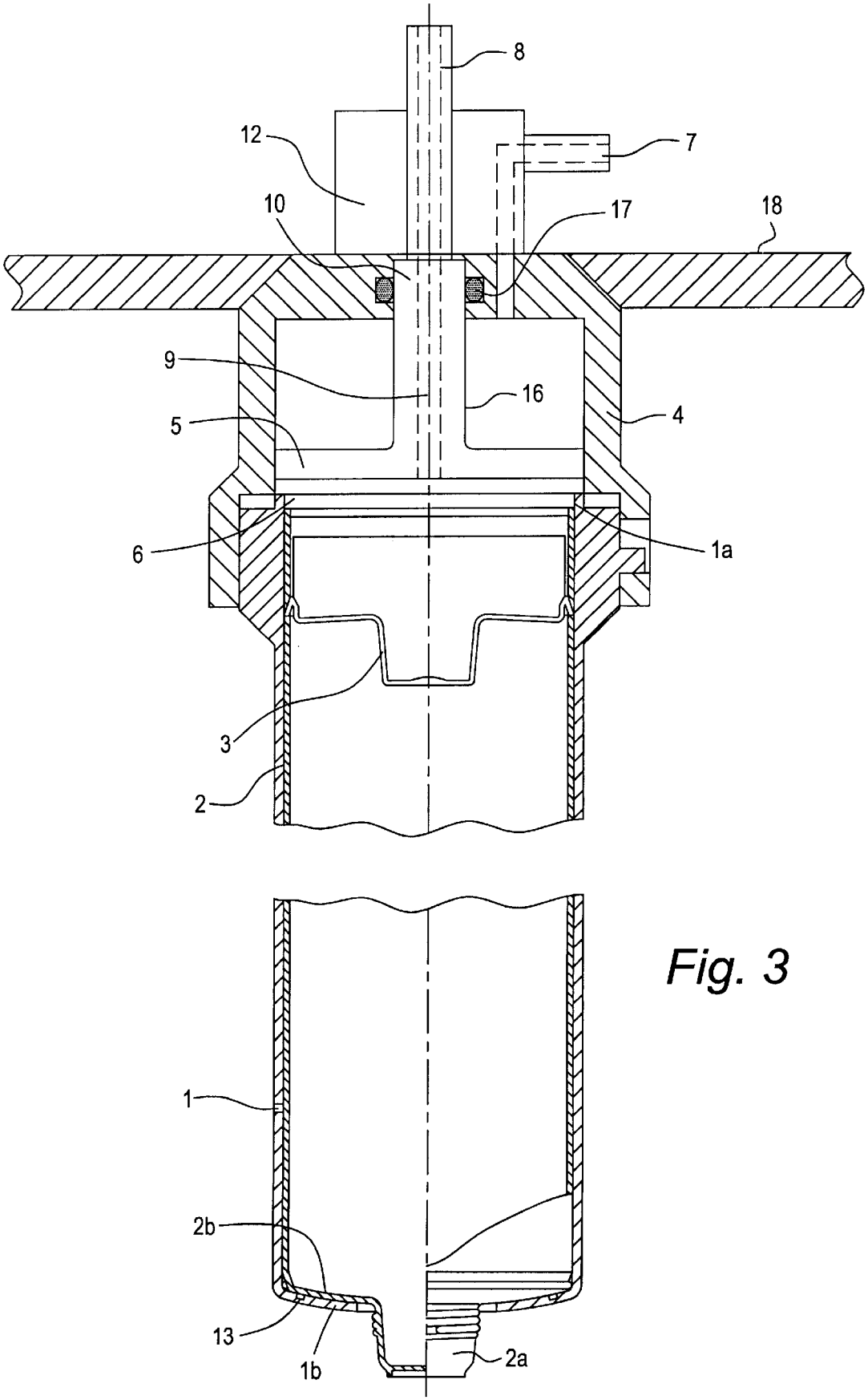
FIG. 3 shows the first cartridge expressing device of FIG. 1 attached to a carriage.
Figure 4:
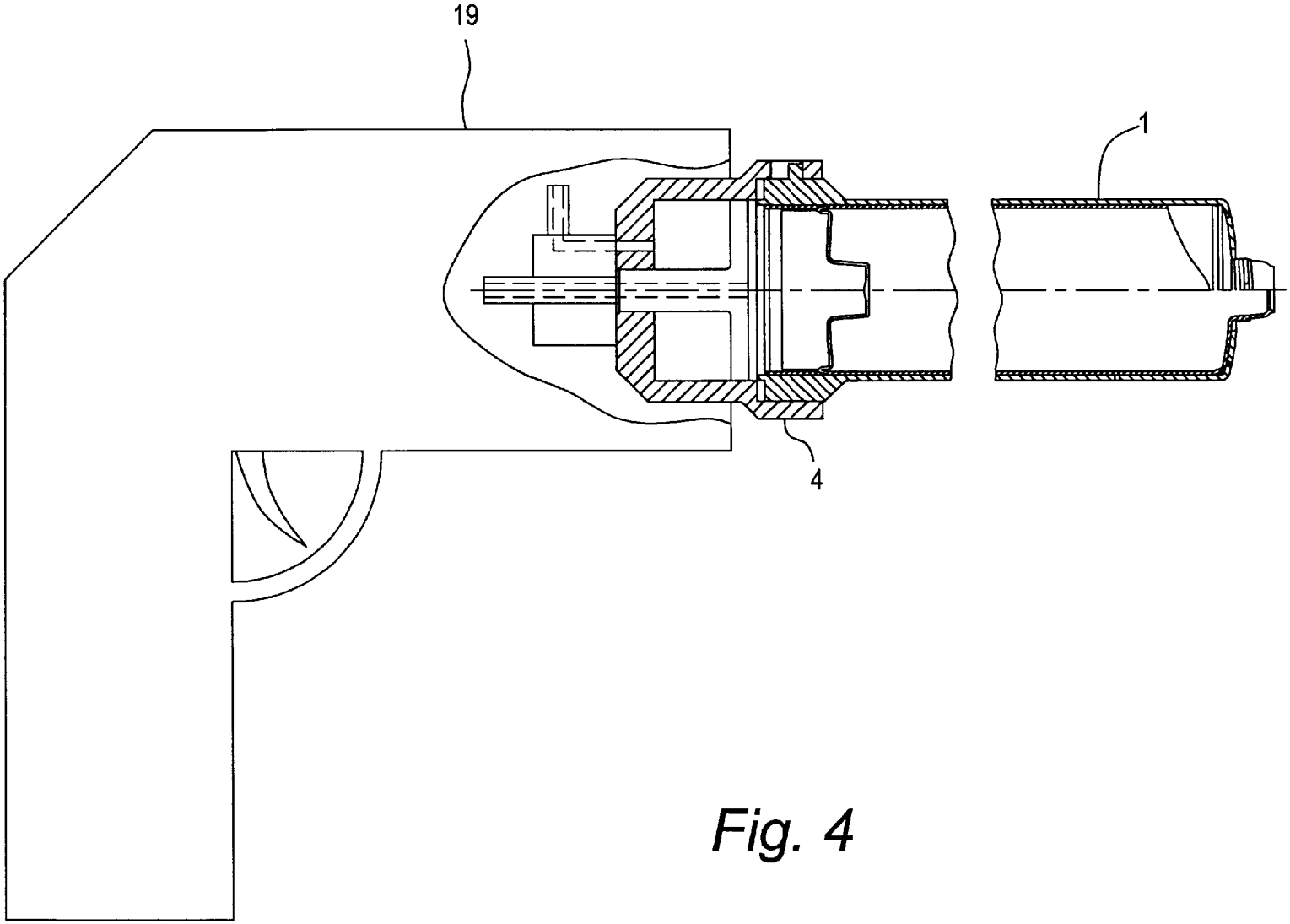
FIG. 4 shows the first cartridge expressing device of FIG. 1 attached to a pneumatic hand gun.

In practice, it can be advantageous to mount cap 4 permanently, for example on a carriage 18 above an ink fountain of a printing unit (FIG. 3) or on a pneumatic hand gun 19 (FIG. 4), and to make holder 1 for the cartridge coupleable therewith by means of a bayonet or screw connection. Of course, however, holder 1 can also be mounted permanently and cap 4 can be made movable and capable of being mounted on said holder, but this requires corresponding mobility of the compressed air connecting hoses.

What is claimed is:

1. A pneumatic cartridge expressing device for expressing tubular cartridges having a mouthpiece at the front and an inserted displaceable cartridge piston at the rear, comprising:

a holder for receiving a cartridge therein with a certain amount of radial play, the holder having a rear end and a front wall, the rear end of the holder projecting axially slightly beyond the rear of the cartridge;

a cap forming a pneumatic cylinder mounted and locked on the rear end of the holder and which contains a cap piston having a bore and an extension, and a cap seal on a side facing the holder that acts as a sealing plate against the rear of the cartridge, the cap having a compressed air connection for supplying compressed air to the displaceable cartridge piston through the bore and an auxiliary compressed air connection for supplying compressed air to the cap piston; and a front end seal between the front wall of the holder and a front end wall of the cartridge, wherein the compressed air connection for supplying compressed air to the displaceable cartridge piston is directly located on the extension of the cap piston, an extension seal is provided between the extension and the cap, and the extension is connected to the bore of the piston.

2. The device according to claim 1, wherein the cap is permanently mounted on a carriage and is removably lockable to the holder for the cartridge.

3. The device according to claim 1, wherein the cap is part of a hand gun and is removably lockable to the holder for the cartridge.

4. A pneumatic cartridge expressing device for expressing tubular cartridges having a mouthpiece at the front and an inserted displaceable cartridge piston at the rear, consisting of:

a holder for receiving a cartridge therein with a certain amount of radial play forming an annular gap, the holder having a rear end and a front wall;

a cap forming a pneumatic cylinder mounted and locked on the rear end of the holder and which contains a cap piston having a bore and a cap seal on a side facing the holder that acts as a sealing plate against the rear of the cartridge, the cap having a compressed air connection for supplying compressed air to the displaceable cartridge piston through the bore, an auxiliary compressed air connection for supplying compressed air to the cap piston, and a counterpressure air connection for supplying air to the annular gap between the holder and the cartridge;

a rear end seal between the cap and the rear end of the holder; and a front end seal between the front wall of the holder and a front end wall of the cartridge.

5. The device according to claim 4, wherein the axial length of the holder is shorter than the cartridge, the rear cartridge end projects axially into cylindrical spaces formed by the cap and the cap piston and the counterpressure air connection is located on the cap and connected by a channel with an outlet in the cylinder wall of the cap at a point located in front of the piston when the piston abuts the rear end of the cartridge.

* * * * *